US012486685B2

(12) United States Patent
Bennett

(10) Patent No.: US 12,486,685 B2
(45) Date of Patent: Dec. 2, 2025

(54) DIVERGING AND CONVERGING SWELLS TO MAKE SURFING WAVES

(71) Applicant: Walter Judson Bennett, Mechanicsville, VA (US)

(72) Inventor: Walter Judson Bennett, Mechanicsville, VA (US)

( * ) Notice: Subject to any disclaimer, the term of this patent is extended or adjusted under 35 U.S.C. 154(b) by 903 days.

(21) Appl. No.: 16/974,414

(22) Filed: Jan. 25, 2021

(65) Prior Publication Data

US 2022/0235569 A1 Jul. 28, 2022

(51) Int. Cl.
*E04H 4/00* (2006.01)
*A63B 69/00* (2006.01)
*E04H 4/14* (2006.01)

(52) U.S. Cl.
CPC ..... *E04H 4/0006* (2013.01); *A63B 69/0093* (2013.01); *E04H 4/14* (2013.01)

(58) Field of Classification Search
CPC ..... E04H 4/0006
USPC ..... 4/491
See application file for complete search history.

(56) References Cited

U.S. PATENT DOCUMENTS 3,350,724 A * 11/1967 Leigh ..... E04H 4/0006 4/491
3,557,559 A 1/1971 Barr
3,973,405 A * 8/1976 Duport ..... E04H 4/0006 4/491
4,515,500 A * 5/1985 Bastenhof ..... E04H 4/0006 4/491
5,342,145 A * 8/1994 Cohen ..... E04H 4/0006 4/491
9,103,133 B2 8/2015 McFarland
10,233,660 B2 3/2019 Lochtefeld
10,364,584 B2 7/2019 Odriozola
10,501,957 B1 12/2019 Trevis
2009/0038067 A1 * 2/2009 Johnson ..... F04D 35/00 4/491
2009/0151064 A1 6/2009 Mladick
2010/0088814 A1 4/2010 Johnson
2014/0189948 A1 7/2014 Lochtefeld et al.
2015/0089731 A1 4/2015 Lochtefeld

* cited by examiner

*Primary Examiner* — Lauren A Crane

(57) ABSTRACT

Disclosed in the current invention is a way to build a low cost and highly efficient surf pool by using diverging and converging swells to create waves for surfing. When a plurality of individual plunger wave generating devices or a single triangle pyramid shaped plunger, force a diverging swell into a first end of a surf pool. The swell then diverges or expands outward until the swell is wide enough to break over an artificial surfing reef. When a plurality of individual plunger wave generating devices in different opposite locations in the surf pool pushes a swell into the surf pool, as the swell transverses it converges into a single swell, which then continues to travel and breaks over an artificial surfing reef.

1 Claim, 8 Drawing Sheets

DIVERGING AND CONVERGING SWELLS TO MAKE SURFING WAVES

BACKGROUND OF THE INVENTION

The artificial wave technology industry has exploded over the past few years. There have been many surf pool design patents and artificial reef patents that have been issued to create artificial waves for surfing. Some of the wave making device technologies patents to produce swells in surf pools have been pneumatic air blowers, plunger wave makers, piston wave makers, plow wave makers, hydro foil wave makers, flap wave makers and water drop wave makers. These wave generating devices are spread out in long widths across the rear of surf pools to create wave generation. The wave generators then push out a swell, that then breaks over bottom bathymetry or contoured slopes to create surfing waves.

The artificial wave generating device technologies cited above, are very costly to build in surf pools or surf lakes. Since the wave generators are spread across the entire back wall area of the surf pool, this makes the surf pools wave generator walls to be long and the surf pool to be wide to accommodate the wide swell. The surf pools have to be very large ranging from 2-11 acres in size. This creates great expenses in the construction of these surf pools. The gallons of water volume in these surf pools run between 2-11 million gallons of water. The cost of each pneumatic chamber, or plunger, or piston module spread across the generator wall and powered by pneumatics or hydraulics can be very costly. The amount of filtration filters, pumps and sanitation equipment is outrageous expensive in the millions of dollar range. The current invention has solved a way to build a low cost and highly efficient surf pool or surf lake by using diverging and converging swells that break over artificial surfing reefs to create waves for surfing. Fewer wave making devices can be used, with smaller wave generating walls needed. This greatly reduces the cost of wave generation and the overall cost to build a surf pool.

SUMMARY OF THE INVENTION

The current invention is using diverging and converging swells to create surfing waves. When a swell diffracts or called diffraction, the swell starts from a starting point called an apex. In the current invention, the apex is located at the point or end of a triangle shaped surf pool design. The triangle shaped surf pool has one to three individual plunger wave generating devices placed at the apex of the triangle shaped surfing pool. More or less plungers or wave making devices can be used but fewer the better. The triangle shaped surf pool can also have one triangle pyramid shaped plunger that fits in the V apex. The concept of the current invention is based on the concept of diffraction and diverging wave technology. The wave generating device and the triangle shaped pool can create diverging expanding transverse waves that break over artificial side surfing reefs located on both sides of the triangle shaped surf pool and an A Frame, slabs, wedges or point break artificial surfing reefs. These reefs are located in the middle of the triangle shaped surf pool. Transverse wave, motion in which all points on a wave oscillate along paths at right angles to the direction of the wave's advance In the current invention there is one to three individual plunger wave making devices used in the triangle surf pool design. The illustrations also show a single triangle pyramid shaped plunger as well. The wave generating device(s) are placed into the apex of the triangle shaped surf pool. The plunger wave generating device pushes a swell into the surf pool. Since the swell begins at the apex of the surf pool, the swell starts to expand outward in a diffraction or diverging way. As the swell transverses and moves toward the beach and the artificial reefs of the surf pool, the swell expands wider and wider and follows the expanding contour triangle shape of the surf pool.

As the diverging waves expand outward, they create transverse or sign waves in a longitudinal fashion. Transverse waves can be defined as a wave that is a moving wave that is made up of oscillations happening perpendicular to the direction of energy transfer. It can also mean that it is a wave that causes the medium to vibrate amazingly at right angles perpendicular to the direction in which they travel parallel to each other.

As the swell leaves the plunger wave generating device(s) the swell starts to diffract and diverge and the swell starts to immediately break over the artificial side reefs on both sides of the triangle shaped surf pool. As the swell continues to transverse forward and expand outward into transverse waves, those transverse waves then break over the A Frame, wedge or slab artificial surfing reefs that are positioned in the center of the triangle shaped surf pool. Multiple artificial reefs can also be placed next to each other to create many surf breaks within the surf pool.

The triangle Pyramid shaped wave generating device can also be placed in a surf pool design to allow the diffracting swell to go toward the left and to the right as the swell diffracts outward. This allows for surf pool designs that can be designed to go from left to right instead of like the triangle surf pool design that goes from back to front of the surf pool. The expanding diverging swell can also be placed around a triangle shape surf pool design where the plunger wave makers push the swell off of the sides of the triangle shaped generator wall. As the swell leaves the sides of the triangle shape generator wall, the swell expands outward from front to back in the surf pool.

The current invention solves the problems from other surf pool design patents, because it is less expensive to build. As there is only one to three individual plunger wave generating devices used to produce a swell into the surf pool. Since the concept of the invention is based on diffraction and diverging wave theories, you don't need multiple wave generating devices as in other patented wave generation technologies. As you only need one to three wave generating units to create wave generation in the surf pool vs other technologies that need multiple chambers, multiple caissons, multiple plungers, or multiple hydro foils. The size of the surf pool is also greatly reduced as you can do more in a smaller area.

To produce a converging swell design, you need wave generating devices opposite of each other. These opposite placed plunger wave generating devices push a swell into the surf pool at different locations and the swells converge together to create one swell. Where the two swells meet is called the conversion point. That converging swell then goes onto break over the artificial surfing reefs to produce a wave for surfing. In the current invention we have illustrated a design for a converging swell that is a Horse Show U shaped surf pool. Three wave generating devices are placed on each side of the Horse Shoe U shaped surf pool. Each of the wave generating devices on each side of the surf pool pushes a swell into the surf pool. The swell breaks along the side reefs and produces a point break wave and as the swell transverses forward the two swells eventually converge in the middle of the surf pool and they go onto break over an A Frame, slab or wedge artificial surfing reef.

A diffraction swell can also be produced in a non-triangular shaped surf pool by placing a group of plunger wave generating devices side by side in a straight line at the rear end of the surf pool or along the sides of a square, pentagon, rectangular, circle or hexagon shaped generator wall configuration. Four to six wave generating devices can be used to push the diverging swell into the surf pool. The wave generating devices are placed in the middle of the rear of the surf pool as an apex point in the pool. These diverging wave generating devices are placed in surf pool shapes other than triangle shape surf pools. As the wave generating devices push waves into the surf pool the swells diffract or expand outward. When the diffracting swell reaches an ample width it then breaks over an artificial surfing reef. This diffracting surf pool design allows for multiple side by side triangle shaped surfing reefs which produces an A Frame wave or slab wave. Meaning the wave can break left or right off of the same reef break.

The triangle pyramid plunger in addition to fitting in a V shaped triangle surf pool, the triangle pyramid plunger can also fit on the corners of a square or rectangle shaped surf pool or surf lake. This can allow extra swell pushes off the corners of the square or rectangle, by the triangle pyramid shaped plungers. The diverging expanding swells off of the corner of the square or rectangle then expand and break over an artificial surfing reef positioned off of the corners.

DETAILED DESCRIPTION OF THE DRAWINGS

Figure 1:
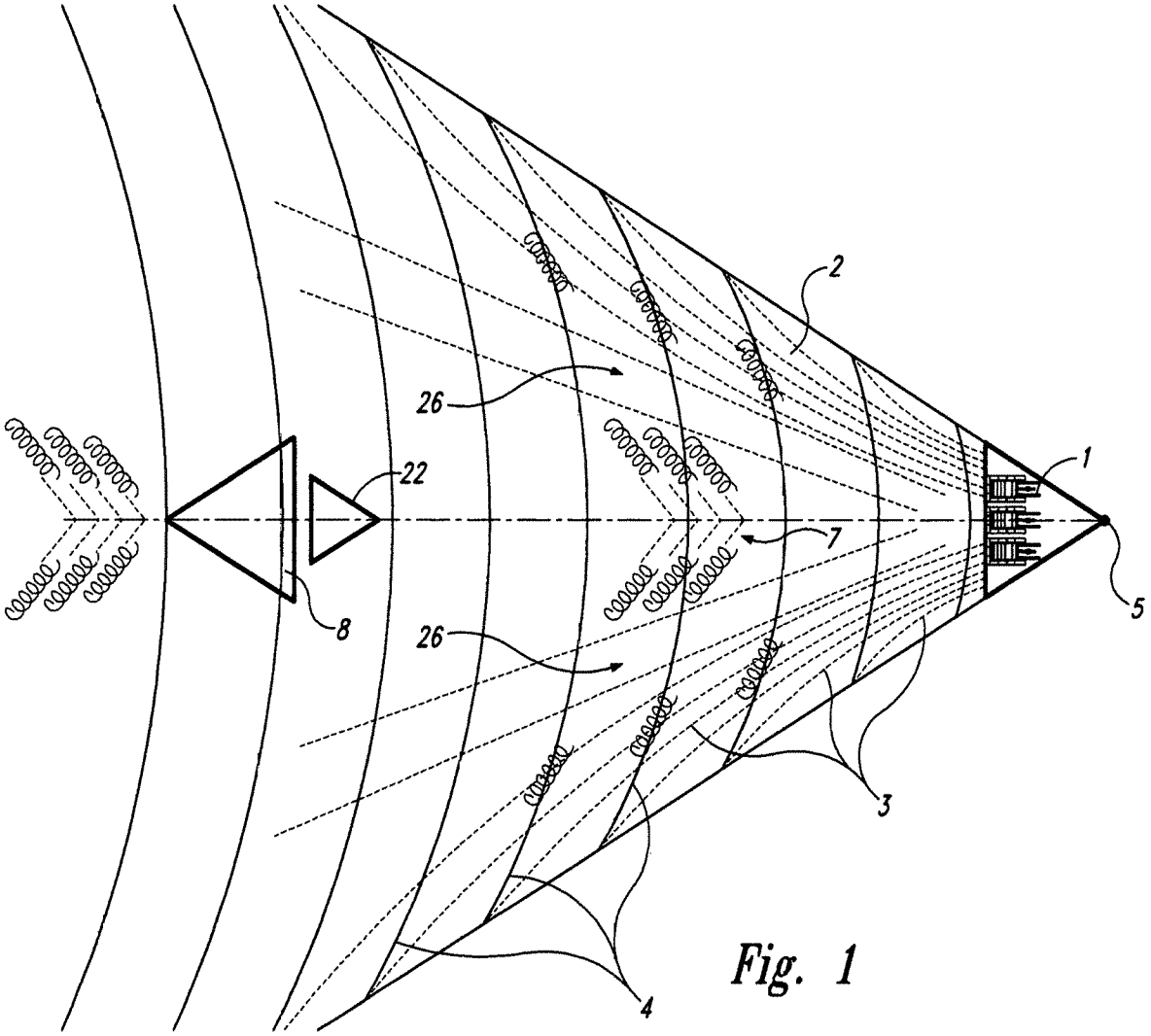
FIG. 1 Top down view of the triangle shaped surf pool with individual plungers wave makers.

FIG. 1. Is a top-down view of the triangle shaped surf pool 2. The individual plunger wave making devices 1, is located at the apex 5 of the triangle shaped surf pool 2. The individual plunger wave making devices 1 oscillates up and down and pushes a diverging swell 4 out into the triangle shaped surf pool 2. As the individual plunger wave making devices 1 pushes a transverse diverging swell into the triangle shaped surf pool 2, the swell creates deflection and diverges the wave to expand outward creating a diverging swell 4. The diverging swells 4 break over the side reefs 3 and also break over the first A frame artificial reef 7. The diverging swells 4 then continue toward the end of the triangle shaped surf pool 2 where the diverging swells 4 diminish in size, where they are then reformed using a second triangle pyramid plunger 22. The diverging swell 4 then encounters a deeper reform section 8 where the diverging swell 4 is then reformed into a larger diverging swell 4.

Figure 2:
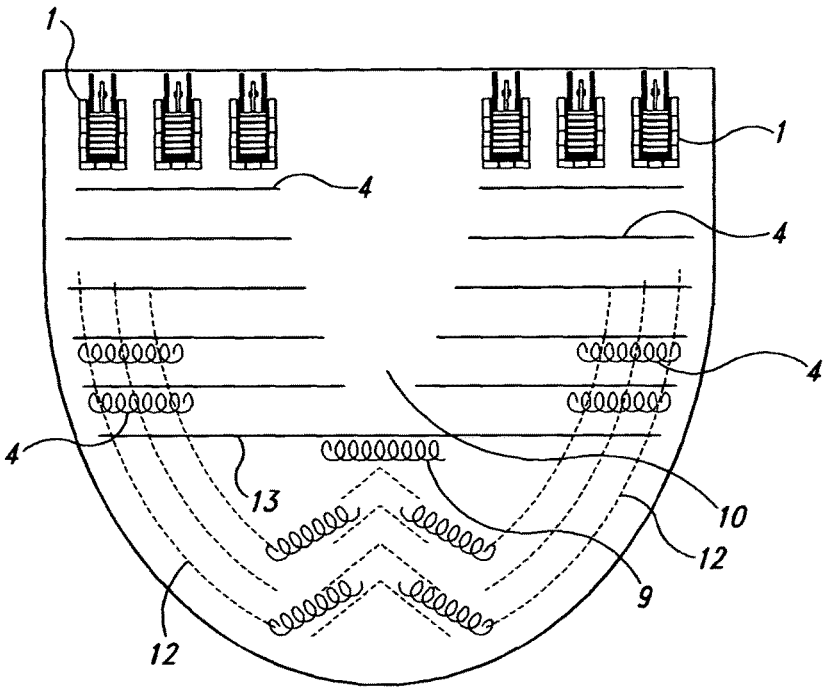
FIG. 2. Top down view of a Horse Shoe U shaped surf pool.

FIG. 2. Is a top down view of a Horse Shoe U shaped surf pool 10. The Horse Shoe U shaped surf pool has three individual plunger wave generating devices 1, on each side of the surf pool 10.

The individual plunger wave making devices 1 oscillate on both sides at the same time and push out a diverging swell 4. The swell travels along the side reefs 12. The diverging swell 4 creates a point break style wave. The diverging swell 4 on each side of the horse shoe pool 10, converge at the converging point 13.

Figure 3:
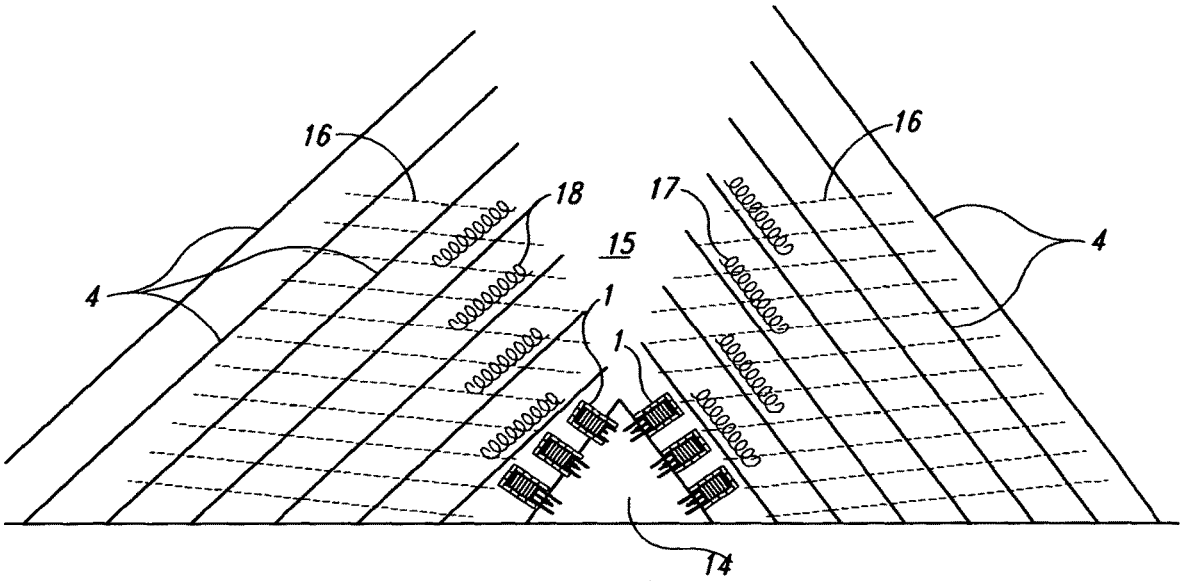
FIG. 3. Top down view of a wave generating device positioned along the sides of a triangle shaped generator wall producing a diverging swell into the surf pool.

FIG. 3. Is a top-down view of the individual plunger wave generating devices 1 in a triangle shape wave generator wall 14 pushing diverging swells in the surf pool 15. The individual plunger wave generating device 1, are positioned in a triangle shape 14, to push diverging swells 4 into the surf pool 15. As the diverging swells 4, push out from the plunger wave makers 1, in a diverging expanding fashion, they break over the contoured bottom 16. As the diverging swells 4 diverge and expand outward into the surf pool they create left 17 and right 18 breaking waves.

Figure 4:
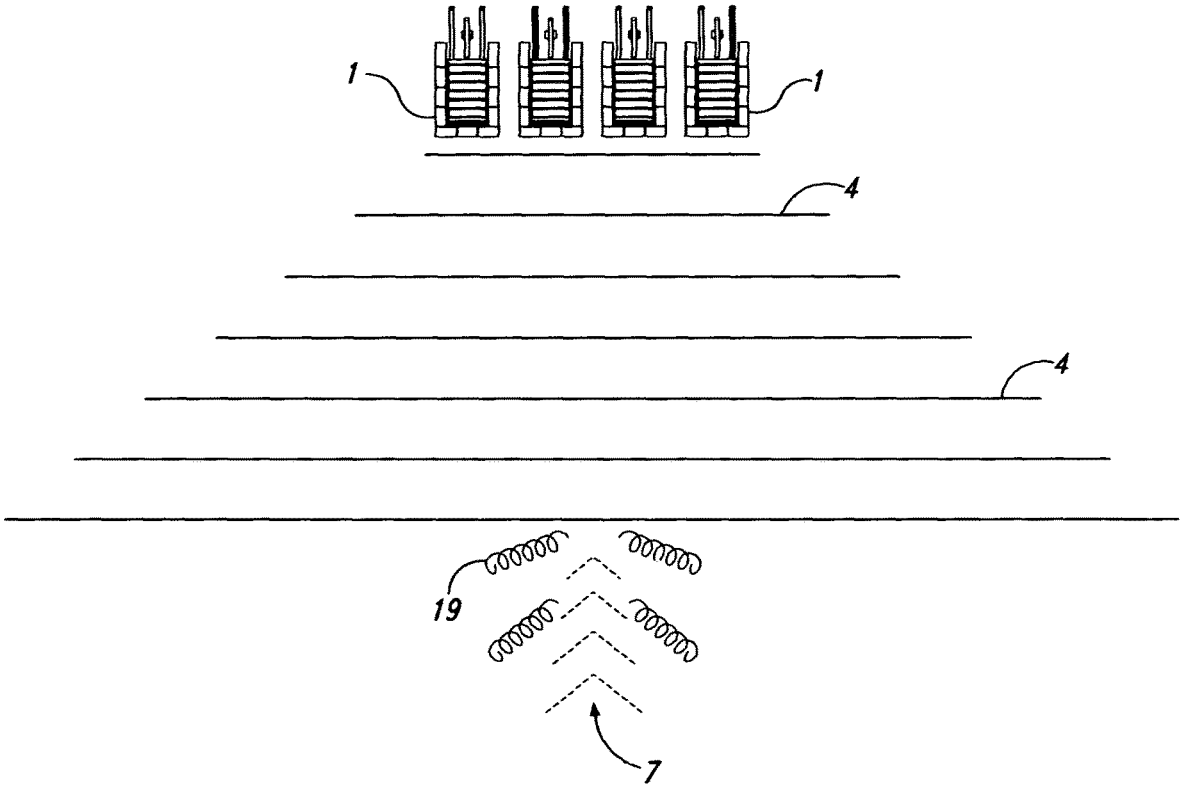
FIG. 4. Top down view of a wave generating device in a straight line shape producing a diverging swell into the surf pool.

FIG. 4. Is a top-down view of the six plunger wave makers 1, arranged in a straight linear line along the rear wall of the surf pool. As the diverging swell 4, transverses into the surf pool the swell diverges and expands out word. When the diverging swell 4 reaches a diverging point where it then breaks of artificial reefs. The Diverging swell 4, can break over any number of reefs as the diverging swell is wide enough to create breaking waves. In this FIG. 4, there is a triangular shaped reef 7. These triangular reefs (A frames), cause the wave to break both left and right at the same time called an A Frame Wave 19.

Figure 5:
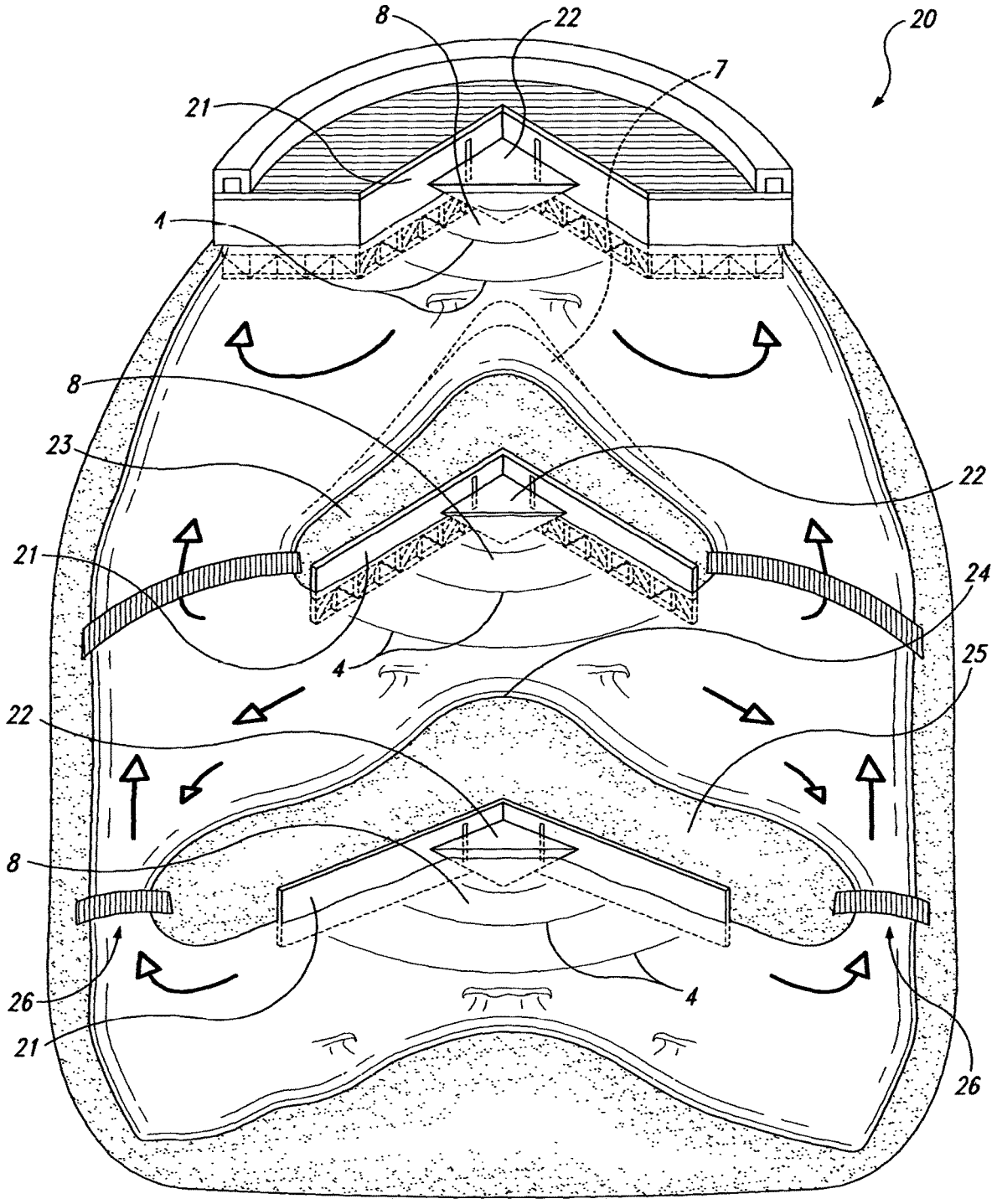
FIG. 5. Top down view of expanding swell technology on three beach reefs in a surf lake, with channels down each sides of the surf lake with triangle pyramid plungers.

FIG. 5. Is a top down view of a three-beach reef surf lake 20. There is a first V shaped section 21, that contains a triangle pyramid shape plunger 22. There is a deep section 8 in front of the triangle pyramid shape plunger 22. There is a first beach reef section 23, that functions as a slab or A frame reef 7, that breaks the wave down the middle to form a left and right breaking wave. At the rear of the first beach reef 23, is a second V shaped section 21, that contains a second triangle pyramid shape plunger 22. In front of the triangle pyramid plunger 22, is a deeper section 8, followed by a second beach reef 25, shaped as double point break 24. At the rear of the second beach reef section 25, is a third V shaped section 21, that has plunger wave making devices 1. In front of the third V section 21, is a deeper area 8. In front of the deeper water 8 is a double beach reef. Running along all three beach reef sections 21, are channels that run down the entire length of the surf lake 26.

Figure 6:
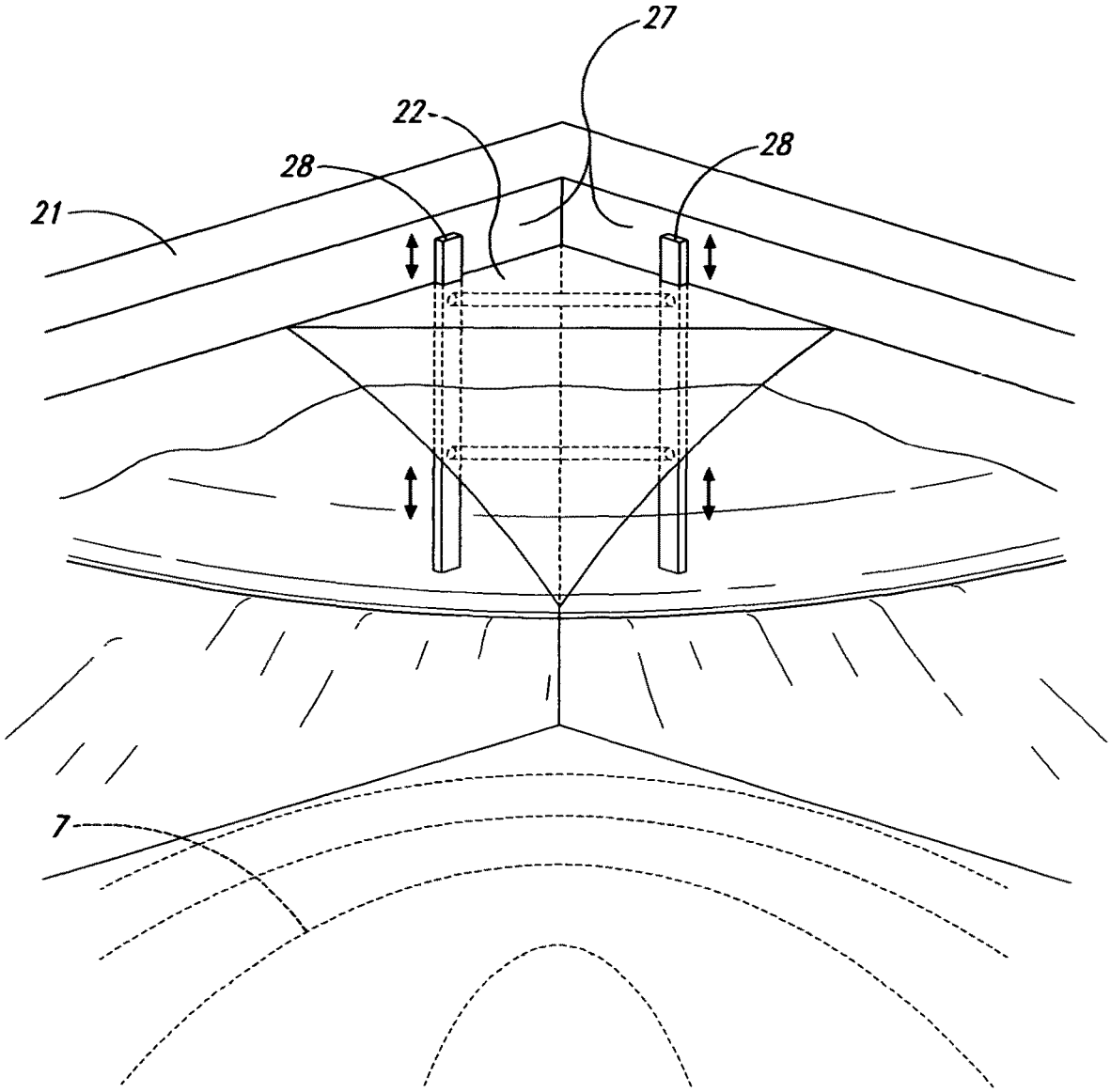
FIG. 6. Front view of a Triangle Pyramid Plunger.

FIG. 6. Is a front facing view of a triangle pyramid shaped plunger 22. The triangle pyramid plunger 22, fits in the V section 21. The wave generator walls that make up the V section are 90-degree walls 27. The triangle pyramid plunger 22, fastens to the V wall 21 with steel wide flange beams 28. The wide flange beams 28 bolt to the triangle pyramid plunger 22, at the upper and lower back of the triangle pyramid plunger 22.

Figure 7:
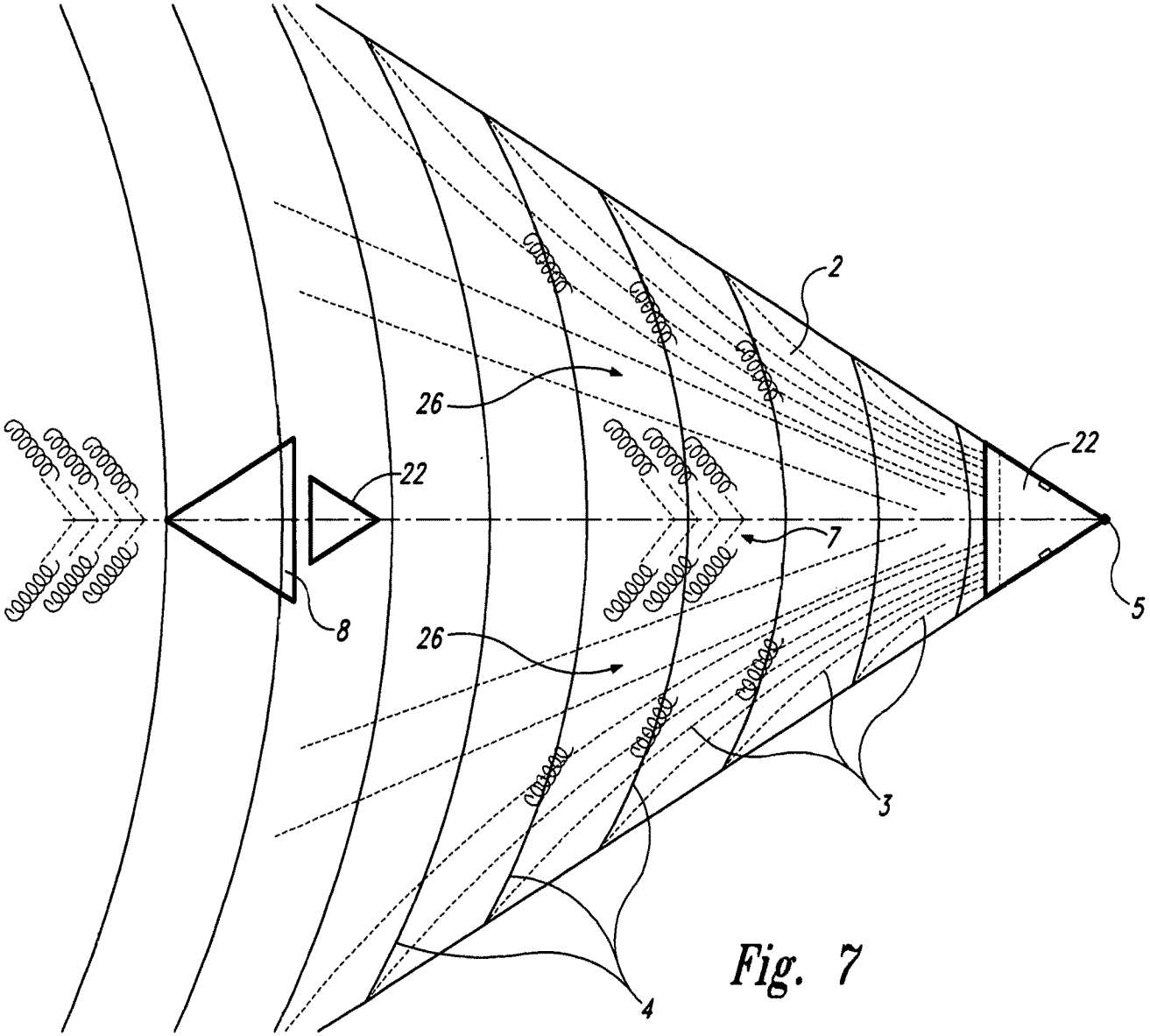
FIG. 7. A top down view of a triangle shaped surf pool with a triangle pyramid shaped plunger.

FIG. 7. Is a top-down view of the triangle shaped surf pool 2. The triangle pyramid shaped plunger 22, is located at the apex 5 of the triangle shaped surf pool 2. The triangle pyramid shaped plunger 22 oscillates up and down and pushes a diverging swell 4 out into the triangle shaped surf pool 2. As the triangle pyramid shaped plunger 22 pushes a diverging swell 4 into the triangle shaped surf pool 2, the diverging swell 4 creates deflection and diverges the wave to expand outward creating a diverging wave 4. The diverging swell 4 breaks over the side reefs 3 and then breaks over the first artificial reef 7. The diverging swell 4 then continue toward the end of the triangle shaped surf pool 2 where the diverging swells 4 diminish in size, where they are then reformed using a second triangle pyramid shaped plunger 22. The diverging swell 4 then encounters a deeper reform section 8 where the diverging swell 4 is then reformed into a larger surfable diverging swell 4.

Figure 8:
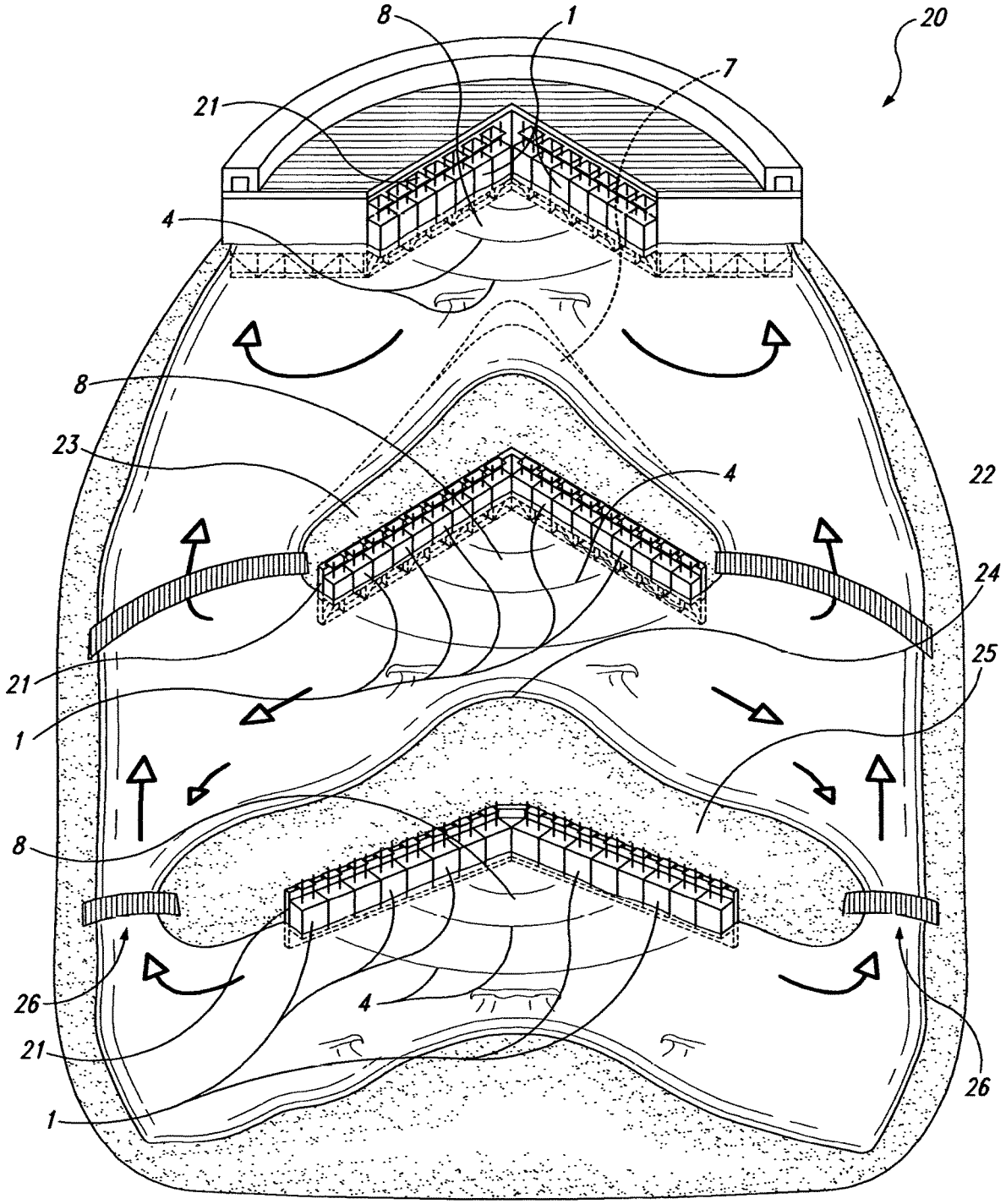
FIG. 8. Top down view of expanding swell technology on three beach reefs in a surf lake, with channels down each sides of the surf lake with plurality of individual plunger wave making devices.

FIG. 8. Is a top down view of a three-beach reef surf lake 20. There is a first V shaped section 21, that contains individual plunger wave makers 1. There is a deep section 8 in front of the individual plunger wave makers 1. There is a first beach reef section 23, that functions as a slab or A frame reef 7, that breaks the wave down the middle to form a left and right breaking wave. At the rear of the first beach reef 23, is a second V shaped section 21, that contains a second set of individual plunger wave makers 1. In front of the individual plunger wave makers 1, is a deeper section 8, followed by a second beach reef 25, shaped as double point break 24. At the rear of the second beach reef section 25, is a third V shaped section 21, that has individual plunger wave making devices 1. In front of the third V section 21, is a deeper area 8. In front of the deeper water 8 is a double beach reef. Running along all three beach reef sections 21, are channels that run down the entire length of the surf lake 26.

Figure 9:
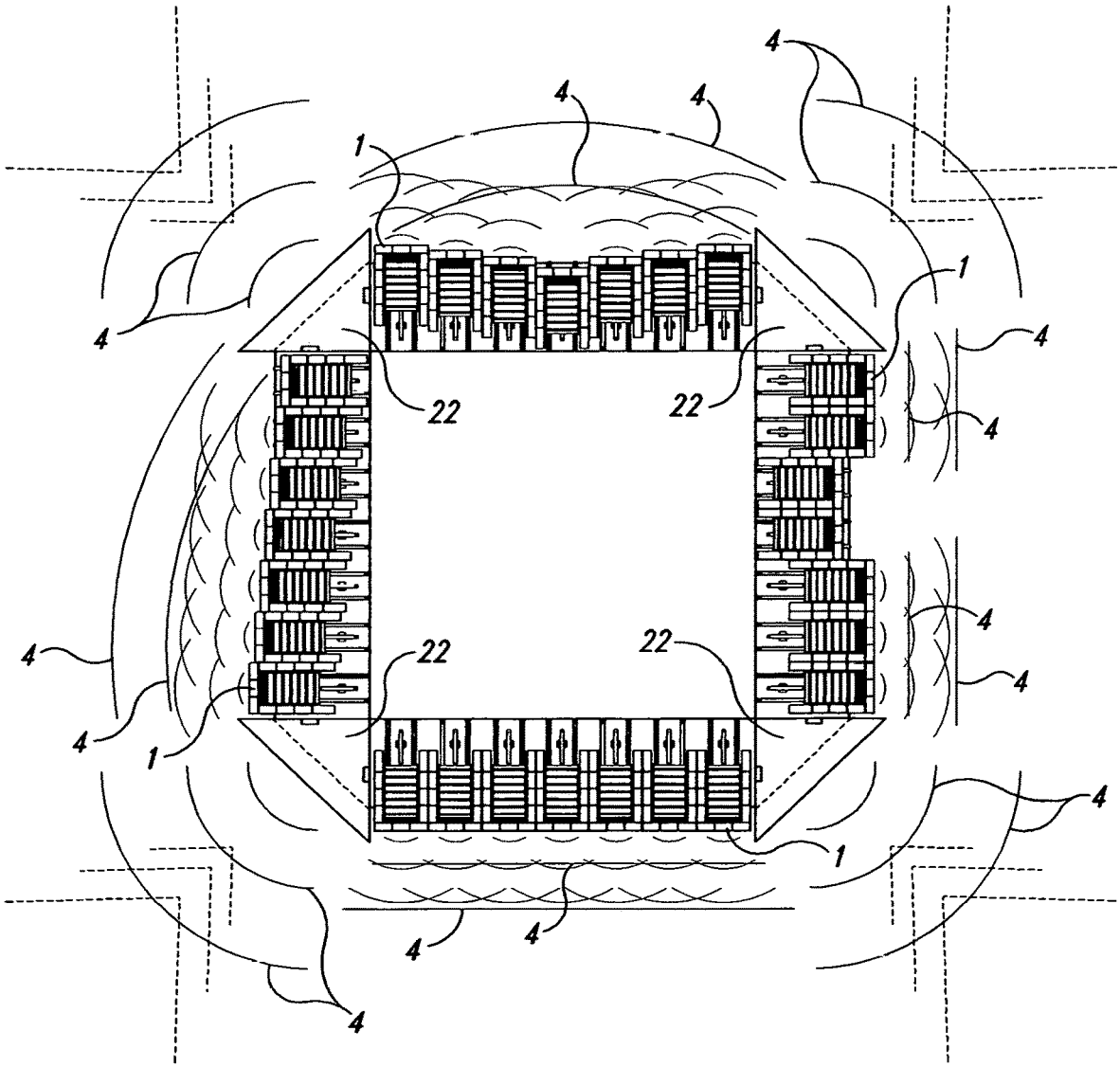
FIG. 9. Is a top down view of a square surf pool with Triangle Pyramid Plungers off each corner and individual plunger wave makers down the sides of the square shaped generator walls.

FIG. 9. Is a top down view of a square sided surf pool. Each side of the square generator wall has a plurality individual plunger wave makers 1 running the length of the sides. On each corner of the square, is a triangle pyramid plunger 22. The individual plunger wave makers 1 push out an expanding swell 4, which break over an artificial reef 7. The triangle pyramid plunger 22 also push off a swell off each of the four corners.

The invention claimed is:

1. A wave pool comprising: A first V-shaped shaped wall having a triangle pyramid shaped plunger configured to push an expanding swell into a body of water towards a first beach area; the first beach having a front side located across from the plunger and a rear side opposite the front side; A second V-shaped wall to the having a triangle pyramid shaped plunger configured to push an expanding swell into a body of water toward a second beach area, the second beach having a front side located across from the plunger and a rear side opposite the front side; A third V-shaped wall having a triangle pyramid shaped plunger configured to push an expanding swell into a body of water toward a third beach area; Wherein the second v-shaped wall is located on the rear side of the first beach area and the third v-shaped wall is located on the rear side of the second beach area.

* * * * *